US005341852A

United States Patent [19]

Corain et al.

[11] Patent Number: 5,341,852

[45] Date of Patent: Aug. 30, 1994

[54] TAKER GRIPPER FOR LOOM USE

[75] Inventors: Luciano Corain; Gianni Maitan, both of Venice; Giulio Bortoli, Schio, all of Italy

[73] Assignee: Nuovopignone Industrie Meccaniche e Fonderia SpA, Florence, Italy

[21] Appl. No.: 62,291

[22] Filed: May 14, 1993

[30] Foreign Application Priority Data

May 22, 1992 [IT] Italy ..... MI 92/A/001240

[51] Int. Cl.[5] ..... D03D 47/20

[52] U.S. Cl. ..... 139/448

[58] Field of Search ..... 139/447, 448, 438

[56] References Cited

U.S. PATENT DOCUMENTS 4,226,265 10/1980 Zollinger ..... 139/448
4,739,805 4/1988 Kohler ..... 139/448
4,860,800 8/1989 Victoor et al. ..... 139/448
5,113,914 5/1992 Corain ..... 139/448
5,129,431 7/1992 Stacher ..... 139/448

FOREIGN PATENT DOCUMENTS 0235078 1/1987 European Pat. Off. .
0285591 3/1988 European Pat. Off. .
2907540 2/1979 Fed. Rep. of Germany .
2083844 8/1981 United Kingdom .

*Primary Examiner*—Andrew M. Falik
*Attorney, Agent, or Firm*—Morgan & Finnegan

[57] ABSTRACT

A taker gripper for loom use in which the weft is gripped and clamped through the combined action of two weft gripping and clamping members. These members are arranged in series along the path of the weft within the gripper. One of the members is of the elastic type and the other member is of the wedge type.

4 Claims, 2 Drawing Sheets 9
10
7
4
5
6
3
8
3
9
12
3
16
14
10
15
11'
11
17
1

10
7
5
4
10
16
14
8
9
6
11'
15
17
11

TAKER GRIPPER FOR LOOM USE

BACKGROUND OF THE INVENTION

2. Field of the Invention

This invention relates to a new taker gripper which, by using two weft gripping and clamping members arranged in series, one of which is of elastic type and the other of wedge type, is particularly suitable for transporting multifilaments, flat wefts, large-section monofilaments or several wefts to be inserted simultaneously.

2. Description of the Prior Art

In the state of the art various types of taker grippers using different weft gripping and clamping members are already known, their efficiency being knowingly one of the most difficult problems to be solved in the field of high-speed shuttleless looms, the difficulty deriving from the contrasting technical requirements of securely clamping the weft yarn so that during transport it is not lost by virtue of the pulling, vibration or intense acceleration always present in such looms, while at the same time softly gripping and transferring said weft yarn so as not to damage it, in that it does not generally possess very high strength.

In one known type of taker gripper the gripping and clamping member consists of the end of a lever pressed by a spring against a corresponding weft gripping surface provided on the gripper body. Such a member, although perfectly satisfying the gripping requirements for multifilaments, flat wefts, large-section monofilaments and several wefts to be inserted simultaneously, is however only able to effect "positive" gripping, which means that during weft yarn reception or release it has to be opened by a further appropriate external control device, this involving a series of considerable problems due substantially to the great difficulty of phasing the gripping and clamping member with said external control device because of the high speed of the loom and in particular because of the inevitable slack which arises between the various mechanical members.

In other known types of taker grippers the gripping and clamping member is of the "negative" gripping type, and consists substantially of a wedge axially movable within a hook in the gripper body, against which it is pressed by a spring, said hook and said wedge being shaped to form between them, on one side, a narrow V recess into which the weft is inserted to remain securely trapped.

These latter gripping and clamping members obviate the said drawbacks of positive gripping, but suffer from the problem of not achieving effective and reliable gripping in the case of multifilament wefts, of flat wefts, of large-section monofilaments or of several wefts to be inserted simultaneously, in that there is only one weft yarn clamping point within said V recess between the wedge and the hook, so that this can only retain the first filament inserted into said V recess, while any other filaments remain poorly clamped or even free. Again, if flat wefts or large-section monofilaments are present a single gripping point is insufficient to ensure effective and reliable clamping because the rigidity of said wefts tends to release them by making them rotate about their gripping point until they escape from the V recess.

SUMMARY OF THE INVENTION

The object of the present invention is to obviate the aforesaid drawbacks by providing a taker gripper of negative gripping type in which the weft gripping and clamping member always ensures effective and reliable transport of any type of weft.

This object is substantially attained in that the weft is always clamped by two gripping and clamping members arranged in series, or which one is of elastic type and the other of wedge type. In this manner, all the filaments are always securely retained by the combined action of the elastic gripping element and the wedge gripping and clamping element.

Hence, the taker gripper for loom use, comprising a gripper body provided at one end with a horizontal hook cooperating with a movable wedge with which it defines on one side a narrow V recess into which the weft to be clamped is inserted, is characterized according to the present invention in that the weft is gripped and clamped by the combined action of two weft gripping and clamping members arranged in series along the path of the weft within the gripper, and of which one is of elastic type and the other is of wedge type.

According to a preferred embodiment of the present invention, said weft gripping and clamping member of elastic type consists of an elastic blade of differential thickness which, rigid with said movable wedge, cooperates only via its greater-thickness outer part with a gripping surface provided on the lower face of said horizontal hook.

In this manner the weft is always securely clamped at the outer edge of the hook.

According to a further preferred embodiment of the present invention said weft gripping and clamping member of wedge type consists of a first lever hinged to the sides of said gripper body and at one end carrying said movable wedge, which is maintained elastically pressed into a frusto-conical cavity in said hook by a spring which acts on tile free end of a second lever, also hinged to the sides of the gripper body, its other end being hinged to tile free end of said first lever.

In order to increase the weft gripping and clamping effect by said gripping and clamping members, according to a further preferred embodiment of the present invention, on said elastic blade there is provided a longitudinal tooth arranged to cooperate with a corresponding groove provided in said gripping surface on said hook.

This determines a labyrinth path for the weft, which is also securely gripped between the blade and the gripping surface on the hook, but only upstream of said labyrinth path because of the differential thickness of said blade, the labyrinth path being situated upstream of the wedge-shaped gripping and clamping member, hence the weft can only escape from this latter with difficulty.

The invention is described in detail hereinafter with reference to the accompanying drawings, which illustrate a preferred embodiment thereof by way of non-limiting example in that technical or constructional modifications can be made thereto without leaving the scope of the present invention. For example, instead of a blade of differential thickness, a constant thickness blade can be used cooperating with a hook having on its lower face a gripping region in the form of inclined surfaces.

DESCRIPTION OF THE PREFERRED EMBODIMENT(S)

Figure 1:
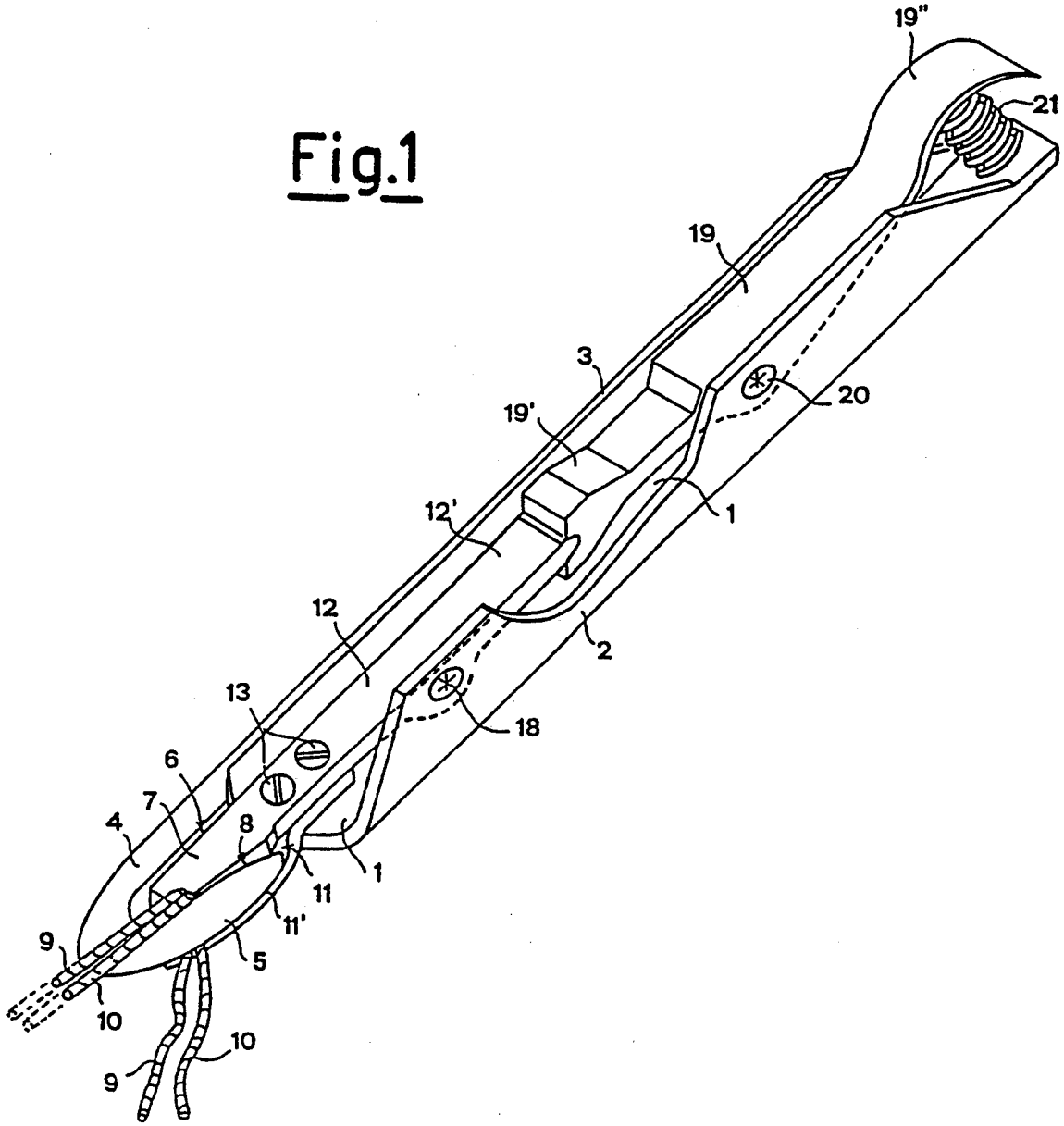
FIG. 1 is a perspective view of a taker gripper using the weft gripping and clamping members of the invention.
Figure 2:
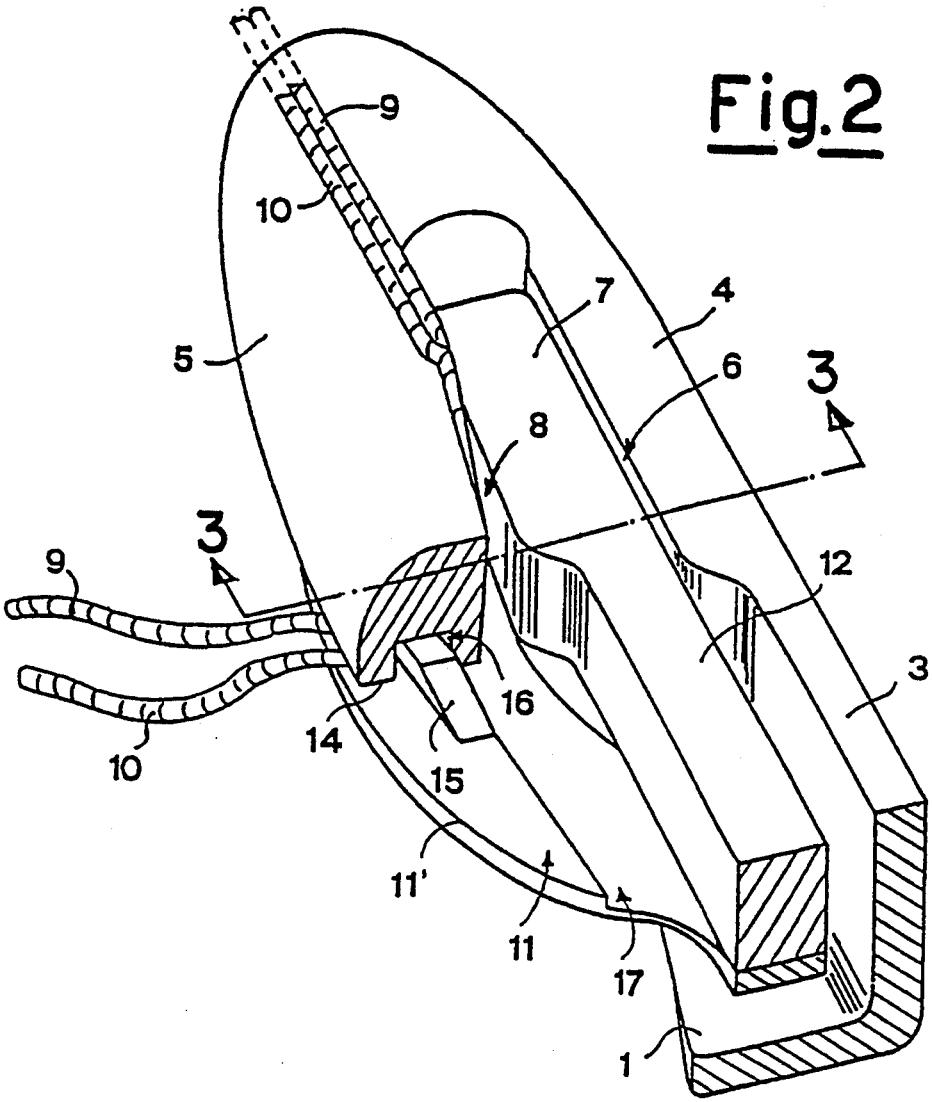
FIG. 2 is a partly sectional perspective view of the hook end of the gripper of FIG. 1.
Figure 3:
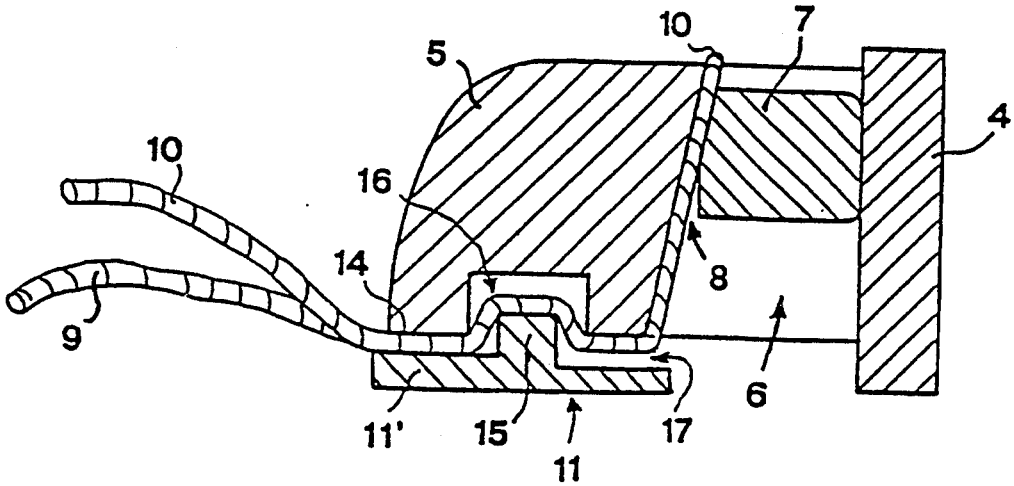
FIG. 3 is a section on the line AA of FIG. 2.

In the figures the reference numeral 1 indicates the taker gripper body comprising two sides 2 and 3 and terminating at its end 4 in a horizontal hook 5. Said horizontal hook 5 defines with said end 4 a frusto-conical cavity 6 (see specifically FIG. 3), against the walls of which there is always elastically pressed a movable wedge 7 carried at the end of a lever 12 and defining with said hook 5 a narrow recess 8 into which the wefts 9 and 10 to be simultaneously clamped are inserted until they remain trapped. It is however apparent that only the initially inserted weft 9 is securely trapped by said weft gripping and clamping member of wedge type 5, 7. To ensure effective and reliable clamping also for the weft 10, in combination with said gripping and clamping member 5, 7 there is also used a weft gripping and clamping member of elastic type, consisting substantially of an elastic blade 11 of differential thickness which, rigidly fixed to said lever 12 of the movable wedge 7 by screws 13 (see specifically FIG. 1), cooperates via its greater-thickness outer part 11' with a gripping surface 14 provided on the lower face of said hook 5. Said blade 11 is also provided with a longitudinal tooth 15 cooperating with a corresponding groove 16 provided in said lower face of the hook 5. In this manner said wefts 9 and 10 are obliged to arrange themselves as indicated in FIG. 3, i.e. to follow a labyrinth path about said tooth 15.

The greater-thickness outer part 11' of the blade 11 ensures that the wefts 9 and 10 are always gripped in this region upstream of the tooth 15 and never in tile region 17 (see specifically FIG. 3) downstream of said tooth 15, even if the weft were to comprise enlargement defects in this region, and this together with said labyrinth path means that an extremely high force is required to withdraw said wefts 9 and 10, so ensuring effective clamping of several wefts simultaneously.

Finally, said lever 12 of the wedge 7 is hinged at 18 to the sides and 3 of the gripper body 1, and its free end 12' is hinged to one end 19' of a second lever 19 which is hinged at 20 to said sides 2 and 3 of the gripper body 1 and cooperates at its free other end 19'' with a spring 21 supported by the gripper body 1 and tending to rotate the lever 19 anti-clockwise, and hence the lever 12 and wedge 7 clockwise so that this latter presses elastically against the walls of said frusto-conical cavity 6. In this manner, if the end 19'' of the lever 19 is pressed against the action of the spring 21, the wedge 7 and the blade 11 are rotated anti-clockwise about the axis 18 to withdraw from the surfaces against which they grip, hence allowing simple removal of the wefts 9 and 10 when the taker gripper has completed its travel.

We claim:

1. A weft taker gripper for loom use, comprising a gripper body having at least one end and at least two sides provided at said one end with a hook having at least one face cooperating with a movable wedge with which it defines on one of said sides a narrow V recess into which a first weft portion to be clamped is inserted in order to form a weft gripping and clamping member of the wedge type, said gripper body further having in series with said hook along the path of the weft within the gripper an elastic blade bearing against said hook to engage a second weft portion therebetween to form a weft gripping and clamping member of the elastic type, wherein the weft is gripped and clamped at said two portions by the independent actions of the series arranged wedge type and elastic type weft gripping and clamping members.

2. A taker gripper for loom use of as claimed in claim 1, characterized in that the movable wedge is supported in the gripper body so that only the thickest part of the wedge cooperates with a gripping surface provided on said at least one face of said hook.

3. A weft taker gripper for loom use comprising a gripper body having at least one end and at least two sides provided at said one end with a hook having at least one face cooperating with a movable wedge with which it defines on one of said sides a narrow V recess into which the weft to be clamped is inserted in order to form a weft gripping and clamping member of the wedge type, and an elastic blade bearing against said hook to engage the weft therebetween to form a weft gripping and clamping member of the elastic type, wherein the weft is gripped and clamped by the combined action of said wedge type and elastic type weft gripping and clamping members arranged in series relative to the weft within the gripper, and in which said weft gripping and clamping member of said wedge type further comprises a first lever hinged to one of said sides of said gripper body, said first lever having a free end and another end, said another first lever end carrying said movable wedge, which is maintained elastically pressed into a frusto-conical cavity in said hook, a second lever having a free end and another end, said second lever being hinged to at least one side of said gripper body, a spring which acts on said free end of said second lever, said another second lever end being hinged to said free end of said first lever.

4. A taker gripper for loom use as claimed in claim 3 in which on said elastic blade there further comprises a longitudinal tooth, and a gripping surface formed on said hook, said gripping surface having a groove formed therein to engage said longitudinal tooth.

* * * * *